US007900385B2

(12) United States Patent
Clark et al.

(10) Patent No.: US 7,900,385 B2
(45) Date of Patent: Mar. 8, 2011

(54) RETAIL DISPLAY SYSTEMS AND METHODS

(75) Inventors: Jeremy A. Clark, Minneapolis, MN (US); Michael A. Whittier, Minneapolis, MN (US); David H. Cheney, Shoreview, MN (US)

(73) Assignee: Target Brands, Inc., Minneapolis, MN (US)

( * ) Notice: Subject to any disclaimer, the term of this patent is extended or adjusted under 35 U.S.C. 154(b) by 476 days.

(21) Appl. No.: 12/046,593

(22) Filed: Mar. 12, 2008

(65) Prior Publication Data

US 2009/0229152 A1 Sep. 17, 2009

(51) Int. Cl.
*G09F 1/08* (2006.01)

(52) U.S. Cl. ..... 40/538; 40/606.12

(58) Field of Classification Search ..... 40/360, 40/538, 606.01, 606.12, 606.14
See application file for complete search history.

(56) References Cited

U.S. PATENT DOCUMENTS

| | | | | | |
|---|---|---|---|---|---|
| 1,219,596 | A | * | 3/1917 | Simmons | 248/300 |
| D59,241 | S | | 10/1921 | Lion | |
| D72,148 | S | | 3/1927 | Gill | |
| D78,366 | S | | 4/1929 | Shepard | |
| D99,034 | S | | 3/1936 | Fevre | |
| 2,240,024 | A | | 4/1941 | Stone et al. | |
| 2,648,151 | A | | 8/1953 | Kindred | |
| 2,737,742 | A | | 3/1956 | Leigh | |
| 2,824,395 | A | | 2/1958 | Decker et al. | |
| D199,471 | S | | 10/1964 | Leibow | |
| 3,630,742 | A | * | 12/1971 | Crawford et al. | 430/529 |
| 3,722,122 | A | | 3/1973 | Sesto | |
| 3,766,675 | A | | 10/1973 | Leigh | |
| 3,969,837 | A | | 7/1976 | Kresse | |
| 4,034,496 | A | | 7/1977 | Cohen | |
| 4,123,862 | A | | 11/1978 | Dyer et al. | |
| 4,214,392 | A | | 7/1980 | Virsen | |
| D283,148 | S | | 3/1986 | Coyne | |
| 4,633,607 | A | | 1/1987 | Brasch et al. | |
| D307,606 | S | | 5/1990 | Jervis, Sr. | |
| D308,229 | S | | 5/1990 | Jervis, Sr. | |
| D308,398 | S | | 6/1990 | Sartz | |
| D314,530 | S | | 2/1991 | Eyal | |
| D316,571 | S | | 4/1991 | Romero-Comas et al. | |
| 5,367,807 | A | * | 11/1994 | Van Beek | 40/606.14 |
| 5,495,568 | A | | 2/1996 | Beavin | |
| 5,530,652 | A | | 6/1996 | Croyle et al. | |
| 5,573,150 | A | | 11/1996 | Trujillo | |
| 5,606,816 | A | | 3/1997 | Schwartz | |
| 5,695,346 | A | | 12/1997 | Sekiguchi et al. | |

(Continued)

OTHER PUBLICATIONS

Jeremy A. Clark, "Retail Display Article and System," U.S. Appl. No. 11/939,462, filed Nov. 13, 2007.

(Continued)

*Primary Examiner* — Gary C Hoge
(74) *Attorney, Agent, or Firm* — Griffiths & Seaton PLLC

(57) ABSTRACT

A retail display system includes a first bracket having a mounting portion defining a substantially arcuate face, a first arm having at least one insertion tab, and a second arm having at least one insertion tab. The first bracket is secured to a back face of a first display article including a backer and an image of a first product. The display article defines a border coterminous with a periphery of the first product. The display article is maintained by the backer by flexing the first display article to shape the first display article to the mounting portion of the first bracket and by securing the flexed, first display article to the first bracket.

18 Claims, 6 Drawing Sheets

U.S. PATENT DOCUMENTS

| | | | | |
|---|---|---|---|---|
| 5,745,666 | A | 4/1998 | Gilley et al. | |
| 5,850,222 | A | 12/1998 | Cone | |
| D414,815 | S | 10/1999 | McDonald | |
| 6,038,797 | A | 3/2000 | Smith | |
| D434,081 | S | 11/2000 | Gruber | |
| 6,144,388 | A | 11/2000 | Bornstein | |
| 6,182,795 | B1 | 2/2001 | Boerer | |
| 6,310,627 | B1 | 10/2001 | Sakaguchi | |
| 6,338,215 | B1 | 1/2002 | Vincent | |
| 6,379,765 | B1 | 4/2002 | Woods | |
| D457,919 | S | 5/2002 | Whittier et al. | |
| 6,404,426 | B1 | 6/2002 | Weaver | |
| 6,418,879 | B1 | 7/2002 | Reiman | |
| D462,999 | S | 9/2002 | Evans et al. | |
| 6,515,025 | B2 | 2/2003 | Hanson et al. | |
| 6,546,309 | B1 | 4/2003 | Gazzuolo | |
| 6,553,699 | B2 | 4/2003 | Edmunds et al. | |
| D478,123 | S | 8/2003 | Marshall | |
| 6,654,046 | B2 | 11/2003 | Eccleshall | |
| 6,688,940 | B2 | 2/2004 | Stanier | |
| 6,820,853 | B1 | 11/2004 | DuBarry | |
| 6,916,436 | B2 | 7/2005 | Tarabula | |
| 7,149,665 | B2 | 12/2006 | Feld et al. | |
| 7,194,327 | B2 | 3/2007 | Lam | |
| 7,212,202 | B2 | 5/2007 | Weaver | |
| 7,296,372 | B2 | 11/2007 | Clark et al. | |
| 2002/0004763 | A1 | 1/2002 | Lam | |
| 2002/0099560 | A1 | 7/2002 | Enfield | |
| 2002/0100198 | A1* | 8/2002 | Stone et al. | 40/616 |
| 2003/0110099 | A1 | 6/2003 | Trajkovic et al. | |
| 2004/0105718 | A1 | 6/2004 | Talaric et al. | |
| 2004/0148833 | A1 | 8/2004 | Virvo | |
| 2006/0070276 | A1* | 4/2006 | Clark et al. | 40/538 |
| 2008/0172917 | A1* | 7/2008 | Brandow et al. | 40/606.14 |

OTHER PUBLICATIONS

"The Benefits and Value of New Generation Holography," <http://www.lithographics.com/applications/applications.htm>.

"Development of a 3D Cad System for the Garment Industry," <http://www.cadcam.ust.hk/research/garment/3d-cad/>.

"eLifesize, The No. 1 Choice for Lifesize Standups Online!" <http://www.elifesize.com/>.

"Flat Mannequins Forms and Display Hangers," <http://www.valuefixtures.ab.ca/bend/flat_mannequins_forms_pg2.htm>.

Full-Color Holograms, with up to Five Seconds of Actual Motion, <http://www.lithographics.com/products/products.htm>.

"Holography 101," <http://www.lithographics.com/technology.htm>.

"Lifesize Celebrity Cardboard Cutouts," <http://www.cardboardcutouts.com/>.

"Male Flat Mannequin," http://www.thefixturezone.com/malflat-man2.html.

Hajewski, "Country Store doing well—Reiman builds successful retail business through catalog sales," <http://www.jsonline.com/bym/news/apr01/hajecol18041701a.asp>, Apr. 2001.

"3D Property Visualization," <http://www.notcon-internet.co.uk/3d_visualisations.htm>.

Chang, "Holograms Go Futuristic," <http://www.findarticles.com/cf_dls/m1590/9_55/55183062/print.jhtml>, Feb. 1999.

"Three-dimensional Analysis and Reconstruction of Paintings," <http://www.eng.ox.ac.uk/NVorld/Research/Frontpage/2000-04/story.html&g- t;, Apr. 2000.

* cited by examiner

RETAIL DISPLAY SYSTEMS AND METHODS

BACKGROUND

Retail businesses typically use a wide variety of display systems and articles to draw consumer attention to the products being sold. The display systems help the consumer envision how the product will look when worn, used, assembled, etc. Conventional display systems often incorporate the product itself to help the consumer envision use or wear of the product. For example, in the clothing sector, clothing is typically displayed on a three-dimensional mannequin in order to generally demonstrate the fit and cut of the clothing. Such display systems highlight particular products to possible consumers to increase the probability that a particular consumer will purchase the product.

SUMMARY

Some aspects of the present invention relate to a retail display system that includes a first bracket having a mounting portion defining a substantially arcuate face, a first arm having at least one insertion tab, and a second arm having at least one insertion tab. The first bracket is secured to a back face of a first display article including a backer and an image of a first product. The display article defines a border coterminous with a periphery of the first product. The display article is maintained by the backer by flexing the first display article to shape the first display article to the mounting portion of the first bracket and by securing the flexed, first display article to the first bracket. Other aspects, including those associated with display systems, display assemblies, and methods of displaying, are also addressed.

DETAILED DESCRIPTION

Figure 1:
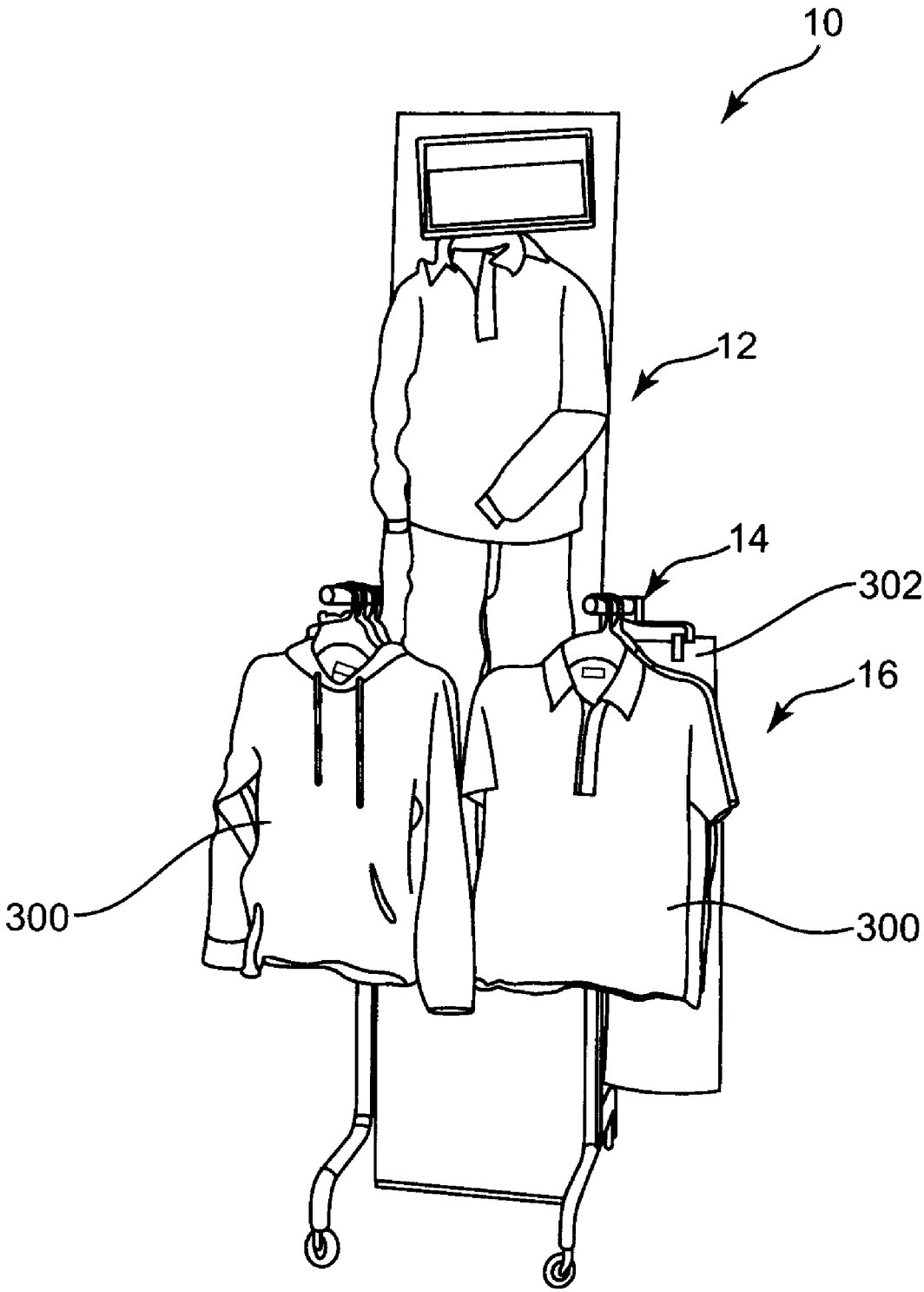
FIG. 1 shows a display system from a perspective view, according to some embodiments.

FIG. 1 shows a display system 10 including a product display assembly 12, a base fixture 14, and products 16. The system 10 is optionally used in a retail area, such as a clothing department of a store, to provide information to consumers or otherwise assist with product retailing, for example. The product display assembly 12 shows an image of a product or products 16 that are being offered for sale or are otherwise on display. In some embodiments, the products 16 being depicted include a clothing item or items, with the product display assembly 12 exhibiting the clothing items in a modeled orientation or in a posed manner otherwise illustrating the overall fit and look of the product 16 as worn.

The base fixture 14 is optionally used to support the product display assembly 12 depicting the products 16, as well as to support a number of the products 16 being depicted. In some embodiments, the base fixture 14 is a portable rack or shelving unit. In some other embodiments, the base fixture 14 is a stationary wall or an end of a stationary shelving unit, often termed an "endcap" according to shelving unit design. As will be understood in greater detail with reference to the following description, some embodiment display systems provide the ability to display products with increased merchandising effect, product visualization, display versatility, and ease of use, for example, although embodiments with additional or alternative features are contemplated.

Figure 2:
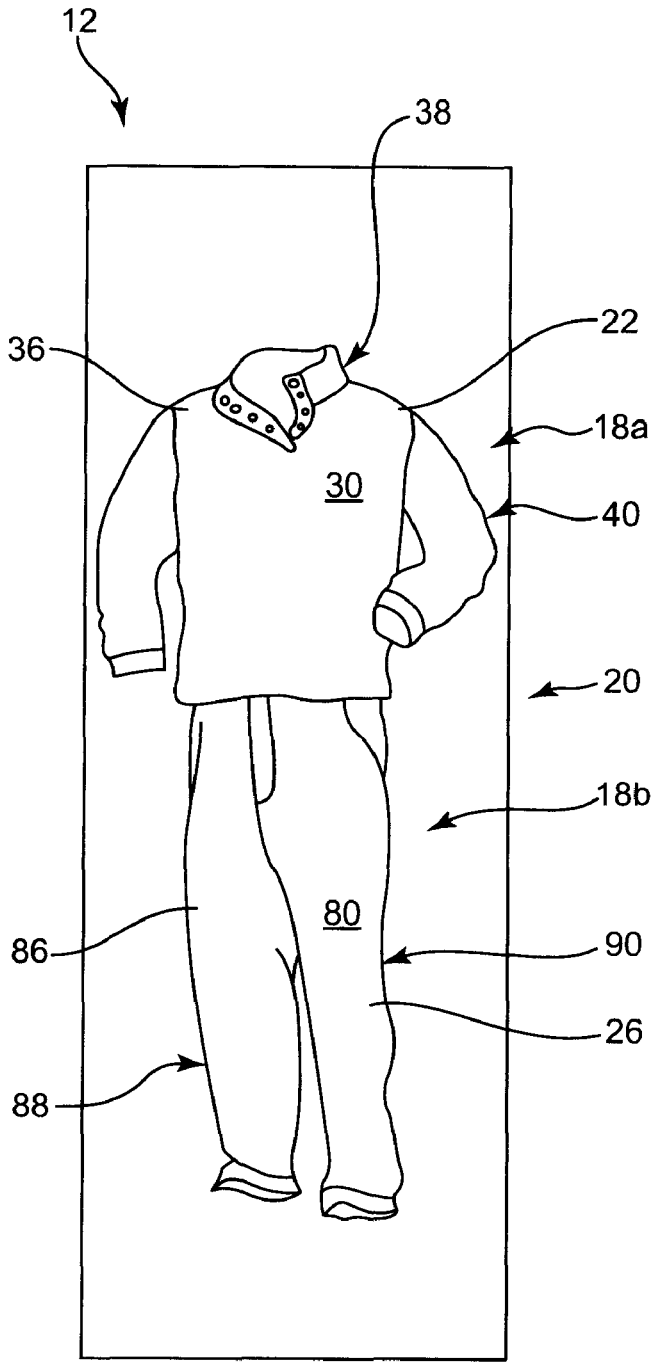
FIG. 2 shows a product assembly of the system of FIG. 1 from a front view, according to some embodiments.
Figure 3:
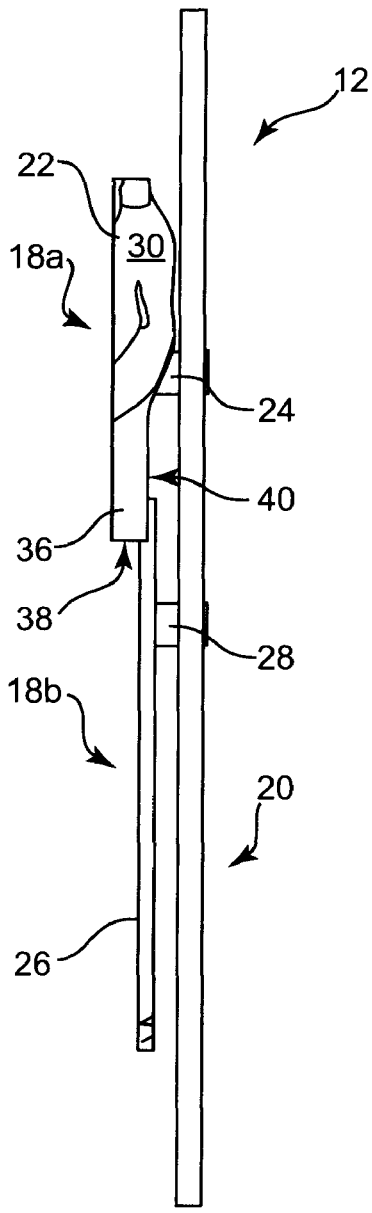
FIG. 3 shows the product assembly of FIG. 2 from a side view, according to some embodiments.
Figure 4:
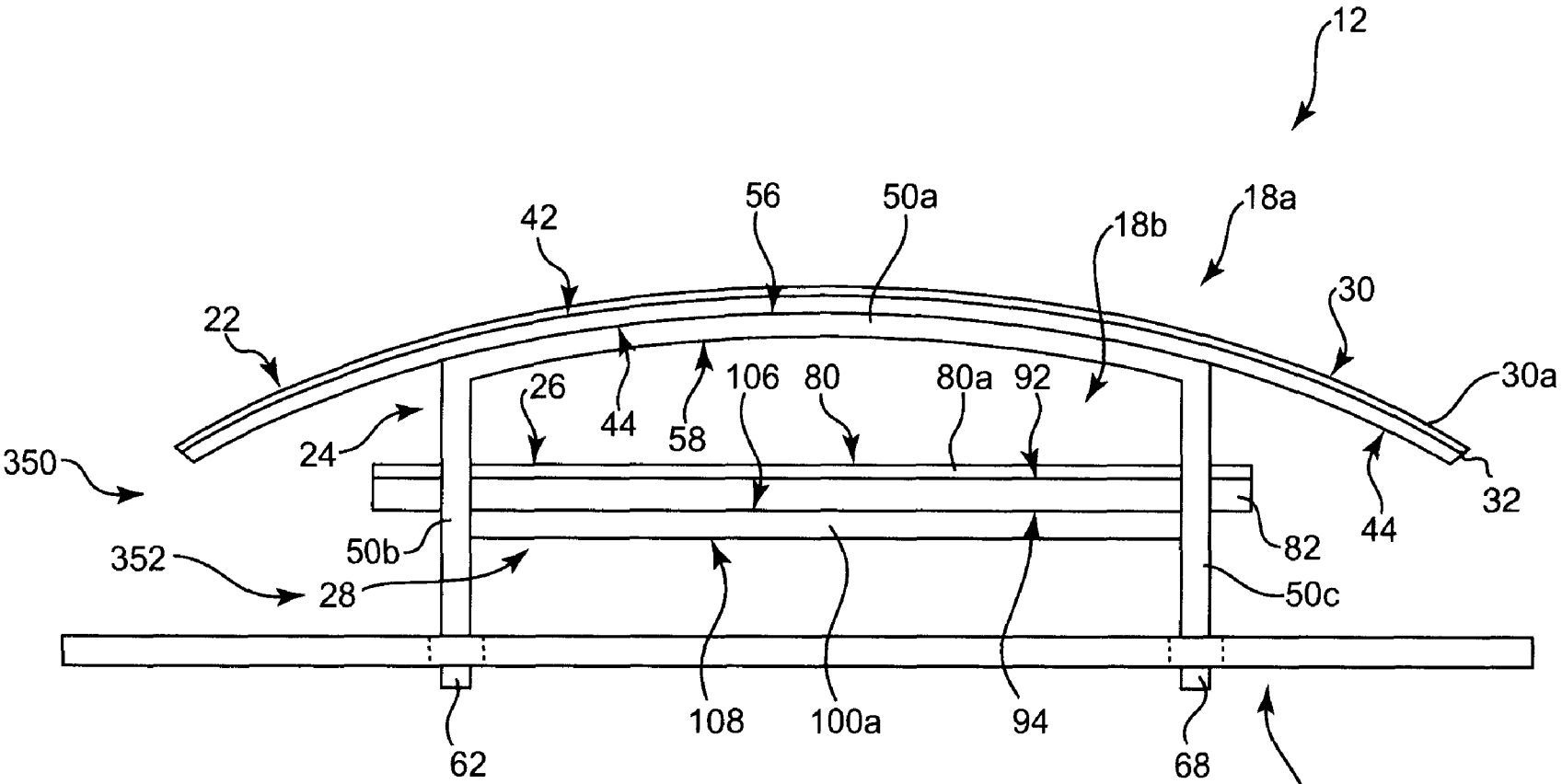
FIG. 4 shows the product assembly of FIG. 2 from a top view, according to some embodiments.

FIGS. 2-4 show the product display assembly 12 from various views. The product display assembly 12 includes first and second mountable signs 18*a*, 18*b* and a mounting board 20. The first mountable sign 18*a* includes a first product signboard 22 and a first mounting bracket 24. The second mountable sign 18*b* includes a second product signboard 26 and a second mounting bracket 28.

As shown in FIG. 4, the first product signboard 22 includes a first product image 30 received by a support panel 32, also described as a support layer. As further described, the first product signboard 22 provides means for visualizing a product 16 during use and for generally enhancing display of the product 16 for sale.

In some embodiments, the first product image 30 is an image of a posed clothing item 36 (for example, a shirt) having an outer edge 38. As shown, the first product image 30 has an outer boundary 40, or periphery, where at least a portion of the outer boundary 40 is substantially coterminous with the outer edge 38 of the posed clothing item 36. In other words, the first product image 30 appears to be a cut out of the posed clothing item 36, with some or all image details extraneous to the posed clothing item 36 removed.

As shown in FIG. 2, the posed clothing item 36 is arranged in a natural position, as if it were actually being worn by a model to show off the features of the clothing item 36 as worn or otherwise being posed in a more natural manner. In some embodiments, the first product image 30 is generated by positioning a product such as the posed clothing item 36 in a folded position or otherwise posed position and an image of the posed clothing item 36 is taken. Some or substantially all portions of the image other than the posed clothing item 36 are then removed. In other embodiments, the posed clothing item 36 is worn by a model, an image is taken, and some or substantially all portions of the image other than the posed clothing item 36 are removed. Examples of some methods of forming product images are described in commonly assigned U.S. Pat. No. 7,296,372 to Clark, et al., which has an earliest associated application publication date of Apr. 6, 2006, issued Nov. 20, 2007, and is incorporated herein by reference in its entirety.

As shown in FIG. 4, in some embodiments, the first product image 30 is received by substantially flexible or formed print media 30*a*, such as an image substrate including a polymeric or other material suited to receive the first product image 30 (for example, a thin sheet of polymeric material, paper, cardstock, velum, transparency, lithograph paper, or others). The first product image 30 is optionally printed on the print media 30*a*, using a suitable printer, or otherwise imprinted on the print media 30*a*. The print media 30*a* optionally includes an adhesive, is tackified, or is otherwise suited for application to the support panel 32. In some other embodiments, the support panel 32 is suited or otherwise adapted to directly receive the first product image 30, for example the first product image 30 is optionally directly printed onto the support panel 32.

Regardless, in accordance with some embodiments, the support panel 32 is generally adapted to support the first product image 30, either directly or by supporting the print media 30*a* onto which the first product image 30 is imprinted or otherwise fixed. The support panel 32 includes a front surface 42 and a back surface 44 opposite front surface 42. A thickness is defined between the front and back surfaces 42, 44 that is sufficient to provide overall structural support to reduce the potential of folding or wilting of the first product signboard 22 under its own weight. The support panel 32 is optionally formed of a generally two-dimensional material such as paperboard or sheet plastic. In some embodiments, the support panel 32 is sufficiently flexible to allow some bending or flexing of the first product signboard 22 as desired, while still providing sufficient overall structural support. For example, the support panel 32 is optionally formed of flexible sheet plastic, cardboard, paperboard, or other suitable material having a suitable bend radius, or radius to which the support panel 32 can be bent without damage. In some embodiments, the support panel 32 is formed of 0.020 inch thick styrene material, although other flexible materials are contemplated. In other embodiments, the support panel 32 is formed of a generally inflexible, or rigid material, such as structural foam, that is rigidly formed with a bent or otherwise flexed configuration as desired.

As alluded to above, the first product image 30 is applied to the front surface 42 of the support panel 32 with an adhesive or tape, or is otherwise secured to the front surface 42. In some embodiments, the support panel 32 is substantially larger than the first product image 30 and the support panel 32 is cut about the perimeter, or periphery, of the first product image 30 to define a cut edge. In other embodiments, the support panel 32 is preformed to the shape of the first product image 30 prior to application to the support panel 32. In still other embodiments, the first product image 30 is secured (for example, directly printed onto or secured thereto via an intermediary, such as the print media 30*a*) to the support panel 32 with the first product image 30 and the support panel 32 being simultaneously cut to the final shape of the first product signboard 22. In some embodiments, the first product image 30 and the support panel 32 are optionally concurrently cut to define the outer boundary 40 of the first product image 30 such that at least a portion of the outer boundary 40 is substantially coterminous with the outer edge 38 of a depicted product, such as the posed clothing item 36.

Cutting the first product signboard 22 to define the cut edge optionally includes cutting out interior background portions of the first product image 30, such as background portions framed between a bent arm and torso portion of the first product image 30 as illustrated in FIG. 1. The first product signboard 22 is cut in a die cut process according to some implementations, although other cutting and forming processes are contemplated.

Figure 5:
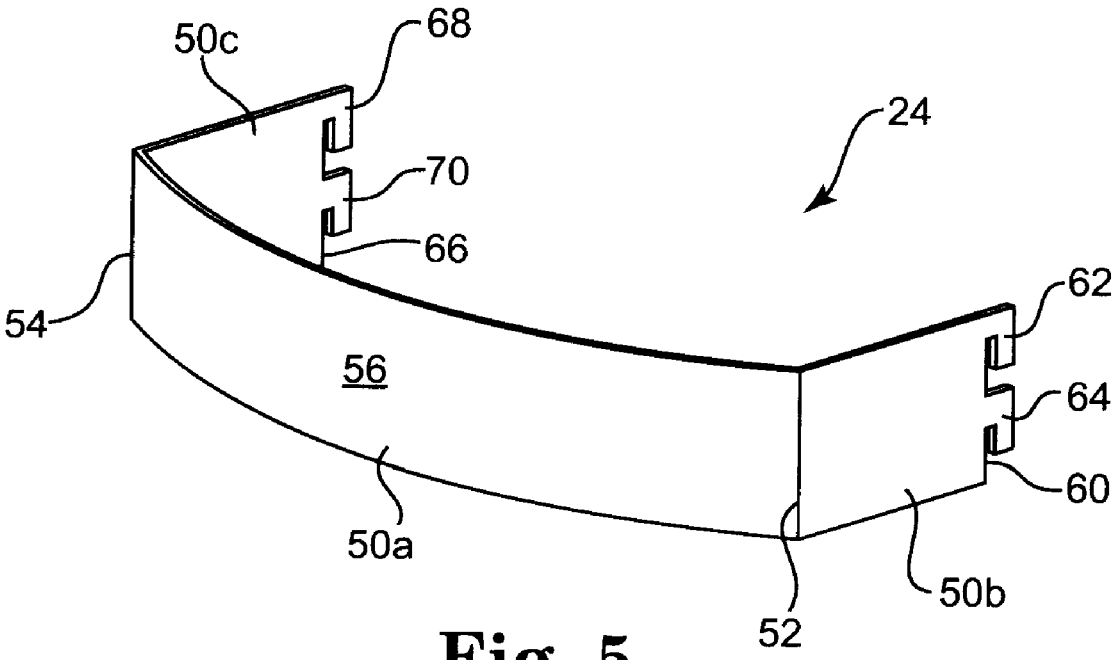
FIG. 5 shows a first mounting bracket of the system of FIG. 1 from an isometric view, according to some embodiments.

FIG. 5 shows the first mounting bracket 24, also described as a mounting member, from a perspective view. As shown in FIG. 5, the first mounting bracket 24 includes a body 50*a*, a first leg 50*b*, and a second leg 50*c*. The first mounting bracket 24 is optionally formed of metal or plastic material, such as PETG having a thickness of about ⅛ inches. The first mounting bracket 24 is formed using molding methods, punching and bending methods, or any of a variety of forming methods according to a particular implementation. As will be described in greater detail, the first mounting bracket 24 provides means for releasably securing the first mounting bracket 24 to the mounting board 20 (FIG. 2).

The body 50*a*, also described as an intermediate portion, extends from a first end 52 to a second end 54 and defines a thickness between a front face 56 and a back face 58 (FIG. 4). As shown in FIG. 5, the body 50*a* is substantially arcuate in shape end-to-end 52, 54, with the front face 56 being curved generally convex and the back face 58 being curved generally concave. In some embodiments, the body 50*a* defines a radius of curvature, such as about 9.75 inches, for example.

The first leg 50*b* extends from the first end 52 of the body 50*a* away from the back face 58 to a terminal end 60. The first leg 50*a* is substantially straight and includes an upper tab 62 and a lower tab 64, also described as insertion tabs, at the terminal end 60. Each of the upper and lower tabs 62, 64 is substantially L-shaped and adapted to be used with an apertured support structure, as subsequently described. The second leg 50*c* extends substantially parallel to the first leg 50*b* from the second end 54 of the body 50*a* away from the back face 58 to a terminal end 66. The second leg 50*c* is substantially straight and includes an upper tab 68 and a lower tab 70, also described as insertion tabs, each of which is also adapted for use with an apertured support structure. For example, in some embodiments the upper and lower tabs 62, 64 of the first leg 50*b* and the upper and lower tabs 68, 70 of the second leg 50*c* provide means for releasably securing the first mounting bracket 24 to the mounting board 20 (FIG. 2).

Assembly of the first mountable sign 18*a* is described with reference to FIGS. 2-4. In some embodiments, the first mountable sign 18*a* is assembled by securing the first mounting bracket 24 to the first product signboard 22, and in particular, to the back surface 44 of the support panel 32 such that the first and second legs 52, 54 extend rearward from the back surface 44 of the support panel 32. The first mounting bracket 24 is secured at a desired height on the product signboard 22, for example toward a bottom, middle, or top of the first product signboard 22 as appropriate.

As shown, the first product signboard 22 tracks or otherwise follows the curvature of the body 50*a* of the first mounting bracket 24 such that the first product signboard 22 is also substantially curved, or bent along its width. In some embodiments, the first product signboard 22 is flexed, or bent to shape the first product signboard 22 to the mounting bracket 24 and the flexed, first product signboard 22 is affixed or otherwise secured to the first mounting bracket 24 using adhesives, rivets, clips, comolding, heat welding, or other fastening means suitable for securing the first product signboard 22 and mounting bracket 24 together. This curved or flexed configuration helps the first mountable sign 18*a* provide a more three-dimensional view of the posed clothing item 36 and optionally causes the first product image 30 to pop out at an observer of the first product signboard 22, thereby enhancing overall realism and merchandising effect of the first mountable sign 18*a*.

The second product signboard 26 includes a second product image 80 received by another support panel 82. Similarly to the first product signboard 22, the second product signboard 26 also optionally provides means for visualizing a product 16 during use and generally enhancing display of products for sale or otherwise on display.

In some embodiments, the second product image 80 is an image of another posed clothing item 86 (for example, a pair of pants) having an outer edge 88. As with the first product image 30, the second product image 80 optionally has an outer boundary 90, or periphery, where at least a portion of the outer boundary 90 is substantially coterminous with the outer edge 88 of the posed clothing item 86. In other words, the second product image 80 appears to be a cut out of the posed clothing item 86, with some or all image details extraneous to the posed clothing item 86 removed. If desired, the first and second posed clothing items 36, 86 are optionally complementary in nature, such as a shirt that goes with, or matches, a pair of pants.

As shown, the posed clothing item 86 is arranged in a natural position, as if it were rumpled to show the length as worn, as if it were actually being worn by a model, or as if the posed clothing item 86 had been otherwise arranged to show off the features of the clothing item 86 as worn. The second product image 80 is optionally generated in any of the manners provided for in association with the first product image 30, for example via any of the methods of forming product images described in U.S. Pat. No. 7,296,372, previously incorporated herein by reference.

As shown in FIG. 4, and as with the first product image 30, the second product image 80 is optionally received by substantially flexible or formed print media 80*a*, or image substrate, suited to receive the second product image 80, including any of those print materials and methods of printing or fixation previously described, for example. In some other embodiments, the support panel 82 is suited or otherwise adapted to directly receive the second product image 80, for example the second product image 80 is optionally directly printed onto the support panel 82.

The support panel 82 supports the second product image 80, either directly or by supporting the print media 80*a* onto which the second product image 80 is imprinted or otherwise fixed. The support panel 82 includes a front surface 92 and a back surface 94 opposite front surface 92. A thickness is defined between the front and back surfaces 92, 94 that is sufficient to provide overall structural support to reduce the potential of folding or wilting of the second product signboard 26 under its own weight. The support panel 82 is optionally formed of a generally two-dimensional material such as those previously referenced. In some embodiments, the support panel 82 is also sufficiently flexible to allow some bending or flexing as desired, while still providing sufficient overall structural support. In other embodiments, the support panel 82 is formed of a generally inflexible, or rigid material that is rigidly formed with a desired configuration.

As alluded to above, the product image 80 is applied to the front surface 92 of the support panel 82. In some embodiments, the support panel 82 is substantially larger than the second product image 80 and the support panel 82 is cut about the perimeter of the second product image 80 to define a cut edge. In other embodiments, the support panel 82 is preformed to the shape of the second product image 80 prior to application to the support panel 82. In still other embodiments, the second product image 80 is secured (for example, directly printed onto or secured thereto via an intermediary, such as the print media 80*a*) to the support panel 82 with the second product image 80 and the support panel 82 being simultaneously cut to the final shape of the second product signboard 26. In particular, in some embodiments, the second product image 80 and the support panel 82 are optionally concurrently cut to define the outer boundary 90 of the second product image 80 such that at least a portion of the outer boundary 90 is substantially coterminous with the outer edge 88 of a depicted product, such as the posed clothing item 86.

Cutting the second product signboard 26 to define the cut edge optionally includes cutting out interior background portions of the second product image 80, such as background portions framed between a bent arm and torso portion of the second product image 80 as illustrated in FIG. 2. The second product signboard 26 is optionally cut in a die cutting operation, although other cutting and forming processes are contemplated.

Figure 6:
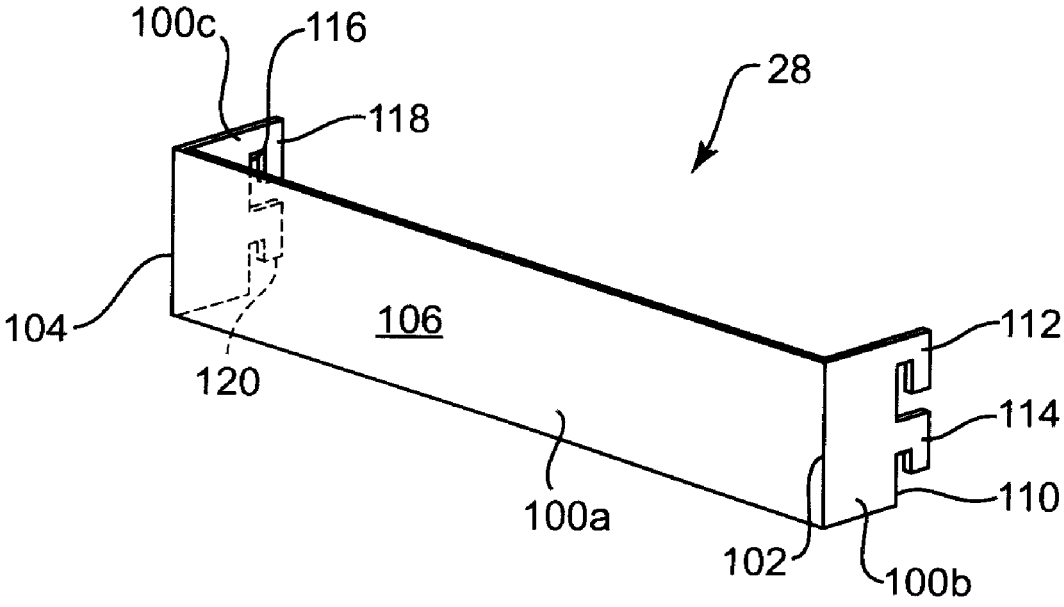
FIG. 6 shows a second mounting bracket of the system of FIG. 1 from an isometric view, according to some embodiments.

FIG. 6 shows the second mounting bracket 28, also described as a mounting member, from a perspective view. As shown in FIG. 6, the second mounting bracket 28 includes a body 100*a*, a first leg 100*b*, and a second leg 100*c*. The second mounting bracket 28 is optionally formed of metal or plastic material, such as PETG having a thickness of about ⅛ inches. The second mounting bracket 28 is formed using molding methods, punching and bending methods, or any of a variety of forming methods, such as those previously described.

The body 100*a*, also described as an intermediate portion, extends from a first end 102 to a second end 104 and defines a thickness between a front face 106 and a back face 108 (FIG. 4). As shown in FIG. 6, the body 100*a* is substantially planar end-to-end 102, 104, with both the front and back faces 106, 108 being generally planar in configuration, though curved or other configurations are contemplated.

The first leg 100*a* extends from the first end 102 of the body 100*a* away from the back face 108 to a terminal end 110. The first leg 100*b* is substantially straight and includes an upper tab 112 and a lower tab 114, also described as insertion tabs, at the terminal end 110. Each of the upper and lower tabs 112, 114 is substantially L-shaped and adapted to be used with an apertured support structure, as subsequently described. The second leg 100*c* extends substantially parallel to the first leg 100*b*, but from the second end 104 of the body 100*a* away from the back face 108 to a terminal end 116. The second leg 100*c* is substantially straight and includes an upper tab 118 and a lower tab 120 (shown in dotted lines), also described as insertion tabs, each of which is also adapted for use with an apertured support structure. For example, in some embodiments the upper and lower tabs 112, 114 of the first leg 100*b* and the upper and lower tabs 118, 120 of the second leg 100*c* provide means for releasably securing the second mounting bracket 28 to the mounting board 20. Each of the first and second legs 100*b*, 100*c* extends substantially orthogonally from the body 100*a*, although angled orientations are also contemplated. In some embodiments, the first and second legs 100*b*, 100*c* are substantially shorter than the first and second legs 50*b*, 50*c* of the first mounting bracket 24 (FIG. 5), as will be subsequently described.

Methods of assembling the second mountable sign 18*b* are described with reference to FIGS. 2-4. As shown and in some embodiments, the second mountable sign 18*b* is assembled by securing the second mounting bracket 28 to the second product signboard 26, and in particular, the back surface 94 of the support panel 82 such that the first and second legs 100*b*, 100*c* extend rearward, back away from the back surface 94 of the second product signboard 26. As shown, the second product signboard 26 tracks, or otherwise follows the planar body 100*a* of the second mounting bracket 28 such that the second product signboard 26 is also substantially planar, or flat along its width. In some embodiments, the second product signboard 26 is affixed or otherwise secured to the second mounting bracket 28 using adhesives, rivets, clips, or other fastening means suitable for securing the second product signboard 26 and mounting bracket 28 together. As described in greater detail, when used in combination with the first mountable sign 18*a*, the planar configuration of the second mountable sign 18*b* provides contrast in depth perception to the first mountable sign 18*a* to help the first and second product images 30, 80 pop out at an observer, thereby enhancing overall merchandising effect.

Figure 7:
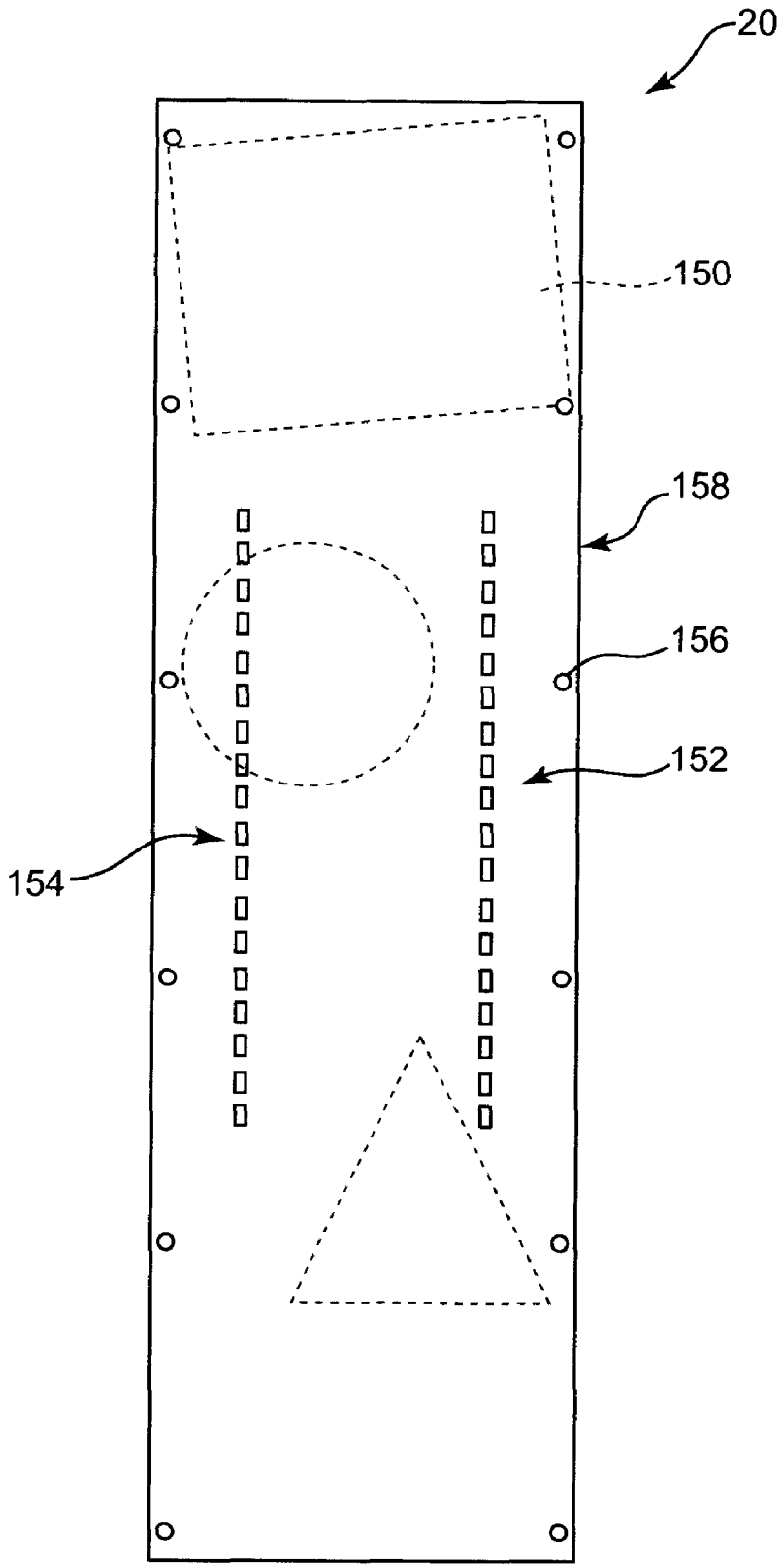
FIG. 7 shows a front view of a mounting board of the system of FIG. 1 from a front view, according to some embodiments.

FIG. 7 shows the mounting board 20, also described as a backer panel, from a front view. As shown in FIG. 7, the mounting board 20 is substantially rectangular in shape, although a variety of shapes are contemplated, and is formed of a panel of material, such as plastic, glass, fiberboard, cardboard, paperboard, or other suitable material. The mounting board 20 has indicia 150, a first column of substantially vertically aligned apertures 152, a second column of substantially vertically aligned apertures 154, and a plurality of fastener holes 156 positioned about a perimeter 158 of the mounting board 20. As shown, the columns of apertures 152, 154 are optionally rectangular and the holes 156 are optionally circular, although a variety of shapes and sizes are contemplated.

The indicia 150 are shown in light dotted lines as geometric shapes, but is optionally adapted to provide information relating to the products 16 (FIG. 1) or otherwise is coordinated with the products 16 and the overall display presentation. For example, the indicia 150 are optionally graphical or textual indicia further identifying the products 16 for sale. Graphical or textual indicia are optionally related to a trademark, brand name, product identifier, slogan, product type or other textual or graphical reference further drawing consumer attention to the products 16 and/or enticing a consumer to purchase the products 16 on display. In other embodiments, the indicia 150 provide unrelated information or a different presentation concept or concepts from that of the first and second mountable signs 18*a*, 18*b* (FIG. 2).

Figure 8:
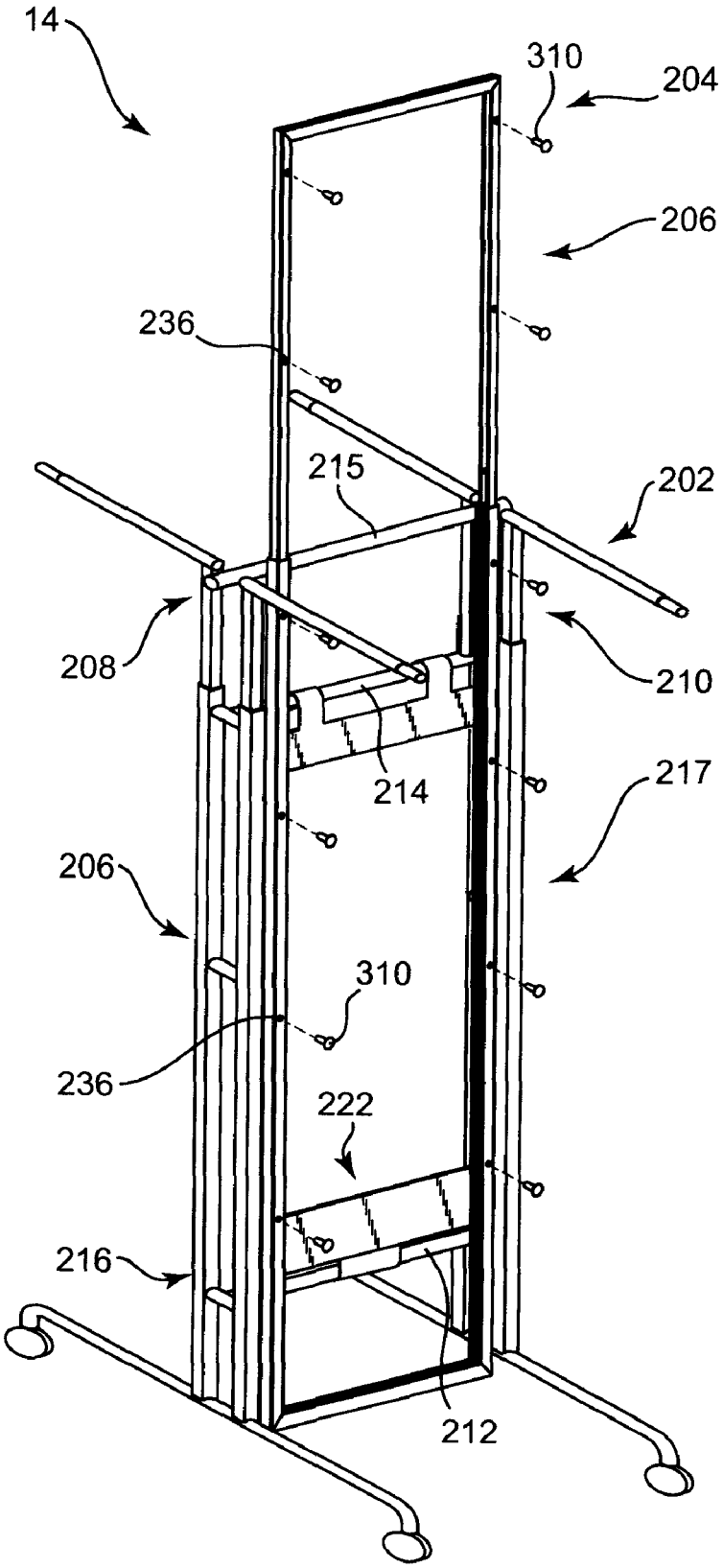
FIG. 8 shows a base fixture of the system of FIG. 1 from a perspective view, according to some embodiments.

FIG. 8 illustrates a base fixture 14 usable with the product display assembly 12. The base fixture 14, also described as a fixture assembly, a racking assembly, or a merchandising assembly, includes a quad-rack fixture 202, also described as a base rack, a base fixture, or a display fixture, and an extendable frame assembly 204, also described as a frame, an extendable billboard attachment, billboard attachment, or a billboard extender. Some suitable product display assemblies are described, for example, in U.S. patent application Ser. No. 11/627,262, filed Jan. 25, 2007, entitled "Display Fixture Accessories," published as U.S. Pat. App. Pub. 2007/0170139 on Jul. 26, 2007, and incorporated by reference herein in its entirety.

The quad-rack fixture 202 is adapted for displaying the products 16, such as clothing maintained on hangers, for example. The quad-rack fixture 202 includes a frame 206, a first extendable arm assembly 208, and a second extendable arm assembly 210. The first and second extendable arm assemblies 208, 210 are optionally adapted for supporting or otherwise maintaining the products 16. The frame 206 includes a lower cross member 212, an intermediate cross member 214, and a top cross member 215. The quad rack fixture 202 includes a first end piece 216 and a second end piece 217, the first and second end pieces 216, 217 adapted to support the quad rack fixture 202 on a surface (not shown).

The telescoping frame assembly 204 of the base fixture 14 has a plurality of spaced-apart holes 236 extending through the telescoping frame assembly 204, serving to assist in securing the mounting board 20 to telescoping frame assembly 204 as desired. However, it should be noted that the plurality of holes 236 are optionally used for a variety of purposes. The telescoping frame assembly 204 is substantially rectangular in shape and supported in a substantially vertical position by the quad-rack fixture 202.

As shown in FIG. 1, the products 16 include a plurality of upper body items 300 and lower body items 302, and can be substantially complementary in nature. In some embodiments the upper body items 300 and lower body items 302 optionally go well together or match. The upper body items 300 optionally include shirts, sweaters, jackets, or other items to be worn on a torso of a person. In turn, the lower body items 302 optionally include pants, shorts, skirts, skorts, knickers, culottes, or other items to be worn on a lower body of a person. Although shown on hangers, the clothing items are optionally presented for display and purchase in a variety of configurations and, although some types of products are specifically listed, any number of different product types and categories, including non-clothing items, are also contemplated.

In some methods of assembling the system 10 and associated methods of displaying products 16, the mounting board 20 (FIG. 7) is secured to the extendable frame assembly 204 of the base fixture 14 using fastening means such as plastic fasteners 310 (FIG. 8), for example. The plastic fasteners are optionally one or more of those sold by ITW Fastex of Des Plaines, Ill. under the trade name "CANOE CLIPS," "CHRISTMAS TREE CLIPS," "PINE TREE CLIPS," and "STALOCK FASTENERS," although other fastening means such as adhesives, metal clips, rivets, or others are contemplated. In some embodiments, the plastic rivets 310 are inserted through the plurality of fastener holes 156 positioned about the mounting board 20 and into the holes 236 in the extendable frame assembly 204, thereby providing means for supporting the mounting board 20 in a substantially upright or substantially vertical position relative to the floor (not shown) of a retail environment, for example.

In some embodiments, the first mountable sign 18*a* (FIGS. 2-4) is releasably secured or otherwise affixed to the mounting board 20 (FIG. 7) using the first and second columns of apertures 152, 154. For example, the upper and lower tabs 62, 64 of the first mounting bracket 24 (FIG. 5) are inserted into a first pair of the apertures 152 and the upper and lower tabs 68, 70 are inserted into a second pair of the apertures 154 that are laterally adjacent the first pair of apertures 152. With the first mountable sign 18*a* positioned at a desired height, the second mountable sign 18*b* (FIGS. 2-4) is similarly secured to the mounting board 20. For example, the upper and lower tabs 112, 114 of the second mounting bracket 28 (FIG. 6) are inserted into a lower pair of the apertures 152 and the upper and lower tabs 118, 120 of the second mounting bracket 28 are inserted into a pair of the apertures 154 adjacent the lower pair of apertures 152 such that the second mountable sign 18*b* is positioned below the first mountable sign 18*a* with a desired amount of overlap.

In particular, and as shown best in FIGS. 3 and 4, the first mountable sign 18*a* is optionally offset outwardly, or set out, in front from the mounting board 20 to a greater degree than the second mountable sign 18*b*, such that the first mountable sign 18*a* defines a first spacing 350 with respect to the mounting board 20 while the second mountable sign 18*b* defines a second, smaller spacing 352, or offset, with the mounting board 20. For example, due at least in part to the arcuate configuration of the first product signboard 22, the first spacing 350 varies from side-to-side with at least some of the first spacing 350 being greater than the second spacing 352. For example, in some embodiments the legs 50*b*, 50*c* of the first mounting bracket 24 are substantially longer than the legs 100*b*, 100*c* of the second mounting bracket 26.

Furthermore, and as shown, the first spacing 350 substantially changes across the width of the first mountable sign 18*a*. In turn, the second spacing 352 is substantially continuous from side-to-side. By positioning the first and second product signboards 22, 26 at two different heights corresponding to how they would be worn by a person, by varying the relative curvature of the product signboards 22, 26, and/or by differing the amounts the product signboards 22, 26 are offset from the mounting board 20, the three-dimensional illusion of overall product display assembly 12 is enhanced as desired. For example, as shown in FIG. 2 the slight overlap of the first product signboard 22 over the second product signboard 26 gives an appearance of a shirt actually hanging down slightly past a pair of pants. Furthermore, the arcuate and more outset appearance of the first product signboard 22 imitates the outward projection of a chest of a person relative to the lower extremities of a person, for example. From this it should be understood that a variety of effects are optionally accomplished by changing orientations, offsets, curvatures, and other features of the product display assembly 12.

As alluded to above, methods of assembling and displaying include hanging or otherwise positioning the products 16 in proximity to the product display assembly 12, for example using the base fixture 14, which provides means for positioning display articles 10 within the retail establishment, relatively near or in proximate position to the actual products 16 being sold to a consumer. Accordingly, a consumer drawn to a particular area due to the display assembly 12 can easily find and access the actual corresponding products 16 for purchase.

In view of the foregoing, the systems, assemblies, and methods of displaying optionally help provide a consumer with the ability to visualize a product during use or wear. Furthermore, due to the lightweight and relatively flat, compact nature of the display articles, the display articles are easily placed for display in a variety of positions and areas otherwise relatively cumbersome to produce with conventional mannequins or display fixtures.

Additional modifications and changes will be apparent to those of ordinary skill in the art. For example, the various features of embodiments described herein can be interchangeably used to provide combinations not specifically described herein. Although the invention has been described with respect to particular embodiments, such embodiments are for illustrative purposes only and should not be considered to limit the invention and various alternatives and changes will be apparent to those of ordinary skill in the art.

The following is claimed:

1. A combination comprising:

a display assembly comprising:

a mounting board having a first column of apertures and a second column of apertures;

a product signboard including:

an image of a posed clothing item having an outer edge, the image having a boundary substantially coterminous with the outer edge of the posed clothing item, and a support panel having a back face and a front face maintaining the image of the posed clothing item; and a mounting bracket including:

a body secured to the back face of the support panel, a first leg extending from the body and away from the back face of the support panel, the first leg being adapted to be releasably secured to the mounting board via the first column of apertures, and a second leg extending from the body away from the back face of the support panel, the second leg being adapted to be releasably secured to the mounting board via the second column of apertures; and a base fixture including:

a first end piece and a second end piece positioned opposite the first end piece, the first end piece and the second end piece being adapted to support the base fixture on a substantially horizontal surface, and a frame that is substantially rectangular in shape, the frame being supported in a substantially vertical position by the first end piece and the second end piece, wherein the mounting board includes a front surface and is secured to the frame, and the product signboard is set out from the front surface of the mounting board such that the product signboard and the front surface of the mounting board define a first spacing therebetween.

2. The combination of claim 1, wherein the product signboard is substantially flexible.

3. The combination of claim 1, wherein the product signboard is substantially flexible and the body of the mounting bracket is substantially arcuate in shape, and further wherein the product signboard is secured to the mounting bracket such that the product signboard bends along the arcuate-shaped body of the mounting bracket.

4. The combination of claim 1, wherein each of the first and second legs of the mounting bracket includes at least one substantially L-shaped tab adapted to be releasably secured into one of the apertures of the first and second columns of apertures, respectively, of the mounting board.

5. The combination of claim 1, wherein the posed clothing item is a shirt including a torso portion, a first arm portion, and a second arm portion, and the shirt is posed by having the first and second arm portions bent inwardly toward the torso portion.

6. The combination of claim 1, further comprising an image substrate for receiving the image of the posed clothing item, the image substrate being secured to the front face of the support panel.

7. The combination of claim 6, wherein the image substrate is a thin sheet of polymeric material.

8. The combination of claim 1, wherein the image of the posed clothing item is printed directly onto the support panel.

9. The combination of claim 1, wherein the first spacing between the product signboard and the front surface of the mounting board substantially changes across a width of the product signboard.

10. The combination of claim 1, wherein:

the product signboard is a first product signboard, the image is a first image, the clothing item is a first clothing item, the support panel is a first support panel, and the combination further comprises:

a second product signboard including a second image of a second clothing item and a second support panel maintaining the second image of the second clothing item; and a second mounting bracket having a portion attached to the second support panel and means for releasably securing the second mounting bracket to the mounting board such that the second product signboard is set out in front of the mounting board, wherein the second product signboard and the front surface of the mounting board define a second spacing that is smaller than the first spacing.

11. The combination of claim 10, further comprising a plurality of the first clothing item and a plurality of the second clothing item, and wherein the base fixture maintains the plurality of first clothing item and the plurality of the second clothing item.

12. The combination of claim 1, wherein the support panel is a substantially flexible panel of material and the body of the mounting bracket defines a substantially curved face that is secured to the support panel such that the product signboard follows the curved face of the body of the mounting bracket.

13. A method of constructing a retail display system, comprising:

providing a first bracket including a mounting portion defining a substantially arcuate face, an arm extending from the mounting portion and having at least one insertion tab; and securing the first bracket to a back face of a first display article including a first backer and an image of a first product, wherein the display article defines a border coterminous with a periphery of the first product, the display article being maintained by the first backer by flexing the first display article to shape the first display article to the mounting portion of the first bracket and securing the flexed, first display article to the first bracket;

providing a second bracket including a mounting portion defining a substantially planar face and an arm having at least one insertion tab and extending from the mounting portion;

securing the second bracket to a back face of a second display article including a second backer and an image of a second product maintained by the second backer; and securing the arm of the first bracket into an aperture formed in a mounting board such that the first display article is offset in front of the mounting board and securing the arm of the second bracket into another aperture formed in the mounting board such that the second display article is positioned below the first display article and is offset in front of the mounting board at a substantially different offset than the first display article.

14. The method of claim 13, further comprising maintaining the first display article in a substantially upright position by securing a mounting board to a base fixture in a substantially upright position and securing the arm of the first bracket to the mounting board.

15. The method of claim 14, further comprising positioning a retail good corresponding to the first product in proximity to the first display article.

16. The method of claim 13, further comprising forming the first display article by printing the image of the first product onto the first backer.

17. The method of claim 13, further comprising forming the first display article by printing the image of the first product onto a printing media and securing the printing media to the first backer.

18. The method of claim 13, further comprising forming the first display article by cutting the first backer about the outer periphery of the first product such that the border of the first display article includes a cut edge.

* * * * *